US009447713B2

(12) United States Patent
Yoon et al.

(10) Patent No.: US 9,447,713 B2
(45) Date of Patent: Sep. 20, 2016

(54) ENGINE BRAKE APPARATUS WITH ROCKER ARM INTEGRATED ACTUATOR

(71) Applicants: Hyundai Motor Company, Seoul (KR); Kia Motors Corporation, Seoul (KR)

(72) Inventors: Seock Joong Yoon, Whasung-Si (KR); Kyung Mo Kim, Whasung-Si (KR); Min Hui Yu, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 359 days.

(21) Appl. No.: 14/244,641

(22) Filed: Apr. 3, 2014

(65) Prior Publication Data

US 2015/0122222 A1 May 7, 2015

(30) Foreign Application Priority Data

Nov. 7, 2013 (KR) ..... 10-2013-0134816

(51) Int. Cl.
*F02D 13/00* (2006.01)
*F01L 13/06* (2006.01)

(52) U.S. Cl.
CPC ..... *F01L 13/065* (2013.01)

(58) Field of Classification Search
CPC ..... F01L 13/06; F01L 1/181; F01L 1/26; F01L 1/2411; F02D 13/04; F02D 9/06
USPC ..... 123/321, 90.12, 90.16, 345
See application file for complete search history.

(56) References Cited

U.S. PATENT DOCUMENTS

| | | | | |
|---|---|---|---|---|
| 6,439,195 | B1 * | 8/2002 | Warner | F01L 13/06 123/320 |
| 8,240,278 | B2 * | 8/2012 | Jeon | F01L 1/18 123/321 |
| 8,434,451 | B2 * | 5/2013 | Yoon | F01L 1/181 123/321 |
| 8,602,000 | B2 * | 12/2013 | Yoon | F01L 1/181 123/321 |
| 2005/0224046 | A1 | 10/2005 | Israel et al. | |
| 2011/0067673 | A1 * | 3/2011 | Yoon | F01L 1/181 123/321 |

FOREIGN PATENT DOCUMENTS

| | | | |
|---|---|---|---|
| JP | 2003-269126 | A | 9/2003 |
| JP | 2004-44399 | A | 2/2004 |
| JP | 2010-261315 | A | 11/2010 |
| KR | 10-2011-0012873 | A | 2/2011 |
| KR | 10-2011-0032212 | A | 3/2011 |

* cited by examiner

*Primary Examiner* — Marguerite McMahon
*Assistant Examiner* — James Kim
(74) *Attorney, Agent, or Firm* — Morgan, Lewis & Bockius LLP

(57) ABSTRACT

An engine brake apparatus may include an exhaust rocker arm having a chamber in which an actuator is slidably inserted, an oil line coupling part which has a central portion extrapolated with an oil line, a communication line communicating with the oil line, a distribution line branched from the communication line and having one portion extending toward a check ball and another portion extending toward a relief valve, a supply line including one portion connected to the check ball and another portion connected to the chamber, and a discharge line including one portion connected to the relief valve and another portion connected to the chamber, wherein the check ball is elastically supported by a check spring in a direction in which the distribution line is closed, and wherein the relief valve is elastically supported by a relief spring in a direction in which the discharge line is opened.

7 Claims, 13 Drawing Sheets

SECTION B-B

SECTION C-C

SECTION B-B

SECTION C-C

SECTION B-B

SECTION C-C

SECTION B-B

SECTION C-C

ENGINE BRAKE APPARATUS WITH ROCKER ARM INTEGRATED ACTUATOR

CROSS-REFERENCE TO RELATED APPLICATION

The present application claims priority to Korean Patent Application No. 10-2013-0134816, filed on Nov. 7, 2013 in the Korean Intellectual Property Office, the entire contents of which is incorporated herein for all purposes by this reference.

BACKGROUND OF THE INVENTION

1. Field of the Invention

The present invention relates to an engine brake apparatus, and more particularly, to an engine brake apparatus, in which a stopper housing according to the related art is removed, an actuator is integrally installed in an exhaust rocker arm, and the actuator is operated by oil pressure so as to maintain a valve lift state.

2. Description of Related Art

FIG. 1 is a perspective view illustrating an engine brake apparatus according to the related art, FIG. 2 is a cross-sectional view illustrating an operation starting time of the engine brake of the engine brake apparatus, and FIG. 3 is a cross-sectional view illustrating an operation state of an engine brake of the engine brake apparatus of FIG. 2.

The engine brake apparatus according to the related art is installed in the vicinity of upper portions of valves which are installed in a cylinder head as illustrated in FIG. 1. An outside of the engine brake apparatus according to the related art is provided with a stopper housing 81 as illustrated at the upper portion of FIG. 1.

When oil is supplied to operate the engine brake, as illustrated in FIGS. 2 and 3, oil is supplied to the actuator 83 to move the actuator 83 up in the above drawings and oil is also supplied to a locking pin 85 which is next to the actuator to insert the locking pin 85 into the side of the actuator so as to fix the position of the actuator, thereby maintaining the valve lift δ.

However, according to the structure of the engine brake apparatus according to the related art, the stopper housing 81 is heavy in weight, the stopper housing may be damaged due to a compression pressure at the time of the operation of the brake and a pressure of a valve spring, and the actuator physically contacts the locking pin, such that durability of the locking pin may be degraded and the locking pin may be inserted into the actuator so as not to be taken off the actuator.

When the stopper housing is damaged, the braking by the engine brake may not be made, and when the locking pin is inserted into the actuator, the restoration may not be made and thus the engine may not be operated properly.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine brake apparatus, in which a stopper housing according to the related art is removed, an actuator is integrally installed in an exhaust rocker arm, and the actuator is operated by an oil pressure so as to maintain a valve lift state.

In an aspect of the present invention, an engine brake apparatus may include an exhaust rocker arm, wherein the exhaust rocker arm may include a chamber which is formed at a front side and in which an actuator is slidably inserted, an oil line coupling part which may have a central portion extrapolated with an oil line, a communication line which communicates with the oil line, a distribution line which is branched from the communication line and may have one portion extending toward a check ball and another portion extending toward a relief valve, a supply line which may have one portion connected to the check ball of the distribution line and another portion connected to the chamber, and a discharge line which may have one portion connected to the relief valve of the distribution line and another portion connected to the chamber, wherein the check ball is elastically supported by a check spring in a direction in which the distribution line is closed, wherein the relief valve is elastically supported by a relief spring in a direction in which the discharge line is opened, and wherein when a pressure of the distribution line is increased, the pressure beats an elastic force of the check spring and the relief spring to open the check ball and close the relief valve.

The actuator is engaged with a return spring which supports the actuator in a direction in which the actuator is retracted, and when a pressure of the chamber is increased, the pressure beats an elastic force of the return spring to protrude the actuator.

The actuator may include a screw which may have one portion formed with a stepped portion, a return spring which is extrapolated into the screw and may have one side end supported by the stepped portion, a head which is formed with a groove in which one portion of the screw is received and is fixed by inserting a stopper and a snap ring into an upper end of the head so as to allow the stopper to support another side end of the return spring in the state in which one portion including the stepped portion of the screw is received in the groove, and a nut which is fastened with another portion of the screw to fix the screw to the chamber.

A rear portion of the exhaust rocker arm is provided with a roller which contacts a cam.

In an aspect of the present invention, in a method of operating an engine brake apparatus including an exhaust rocker arm, wherein the exhaust rocker arm may include a chamber which is formed at a front side and in which an actuator is slidably inserted, an oil line coupling part which may have a central portion extrapolated with an oil line, a communication line which communicates with the oil line, a distribution line which is branched from the communication line and may have one portion extending toward a check ball and another portion extending toward a relief valve, a supply line which may have one portion connected to the check ball of the distribution line and another portion connected to the chamber, and a discharge line which may have one portion connected to the relief valve of the distribution line and another portion connected to the chamber, when a pressure of the oil line, the communication line, and the distribution line is increased, the method may include opening the check ball to supply oil to the chamber through the supply line, and applying the relief valve with the pressure of the distribution line to be closed, when a pressure of the chamber is increased corresponding to the pressure of the oil line, the communication line, and the distribution line, the method may include closing the check ball and the relief valve, and when the pressure of the oil line, the communication line, and the distribution line is reduced, the method may include closing the check ball and opening the relief valve to discharge the oil in the chamber through the discharge line.

When the oil is supplied to the chamber, the actuator protrudes and when the oil is discharged from the chamber, the actuator is retracted.

When the actuator protrudes, the actuator maintains a valve lift even when the exhaust rocker arm arrives in a vicinity of a top dead center.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
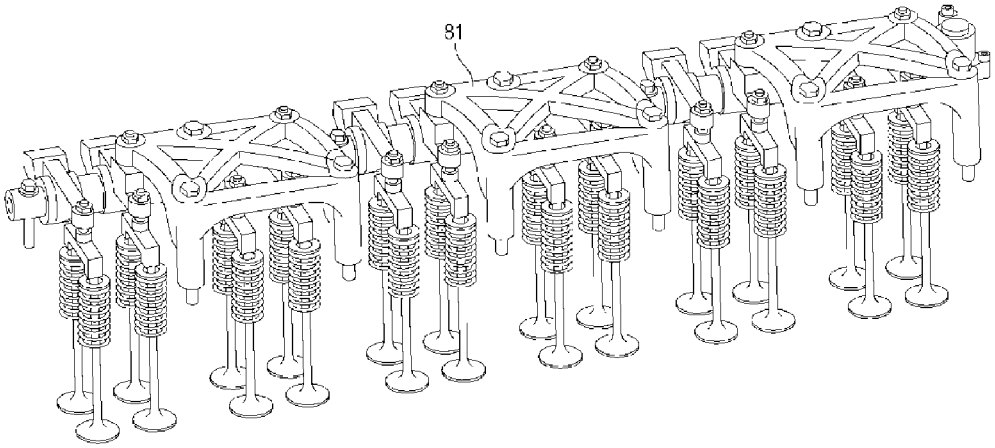
FIG 1. (Related art)
FIG. 1 is a perspective view illustrating an engine brake apparatus according to the related art.
Figure 2:
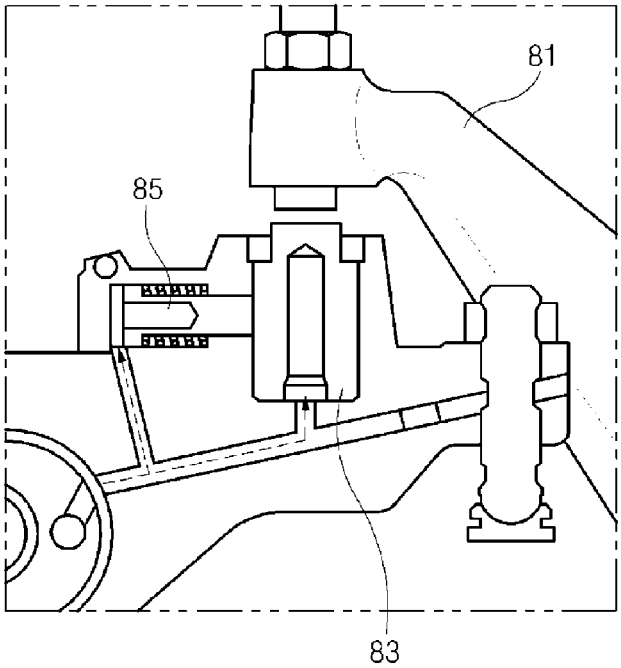
FIG 2. (Related art)
FIG. 2 is a cross-sectional view illustrating an operation starting time of an engine brake of the engine brake apparatus of FIG. 1.
Figure 3:
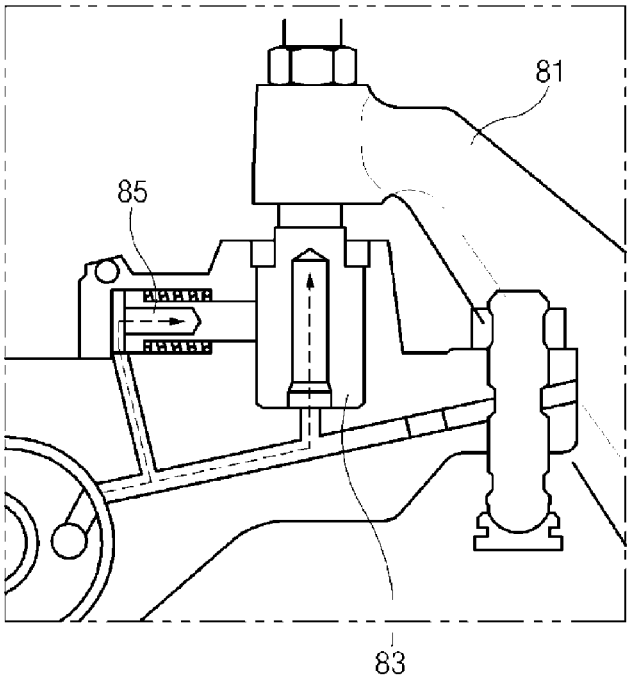
FIG 3. (Related art)
FIG. 3 is a cross-sectional view illustrating an operation state of an engine brake of the engine brake apparatus of FIG. 2.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described in detail with reference to the accompanying drawings.

Figure 4:
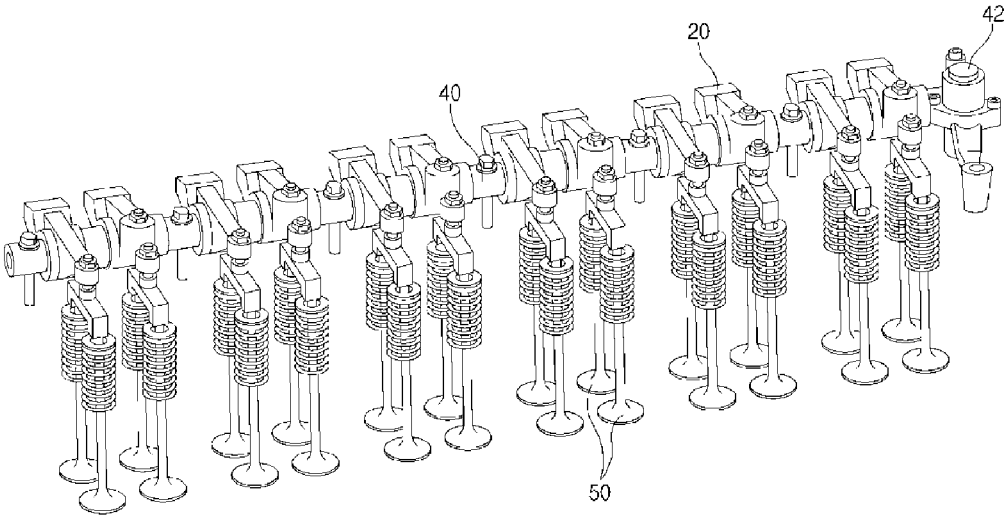
FIG. 4 is a perspective view illustrating an engine brake apparatus according to an exemplary embodiment of the present invention.
Figure 5:
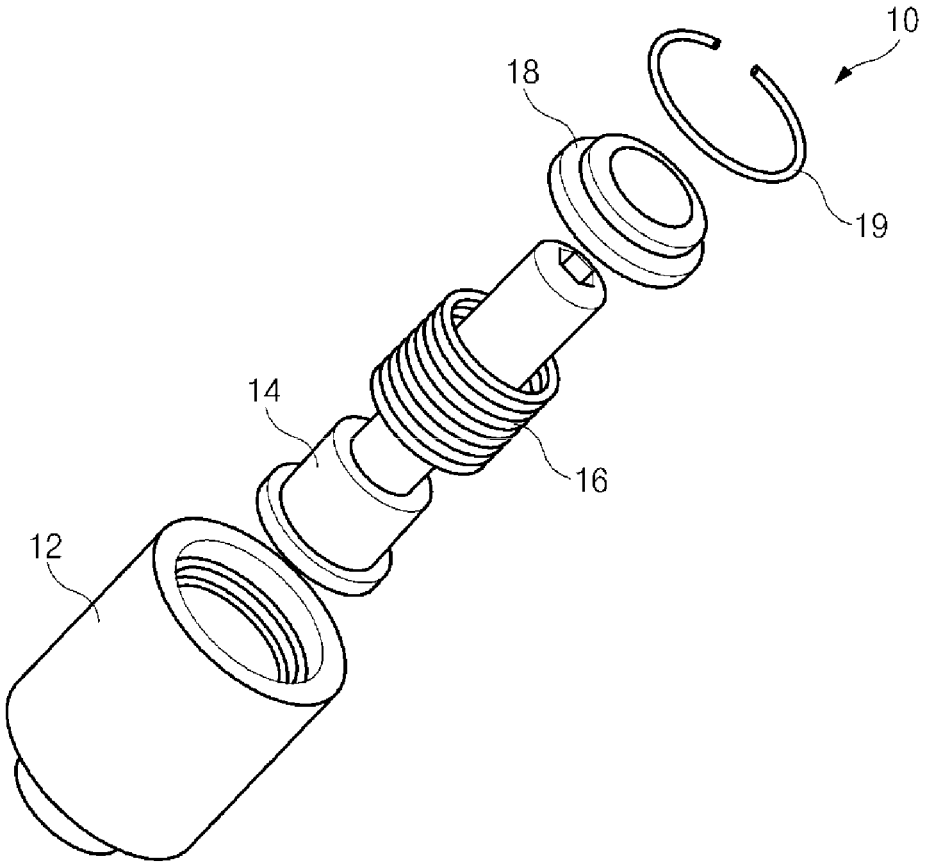
FIG. 5 is an exploded perspective view of an actuator.
Figure 6:
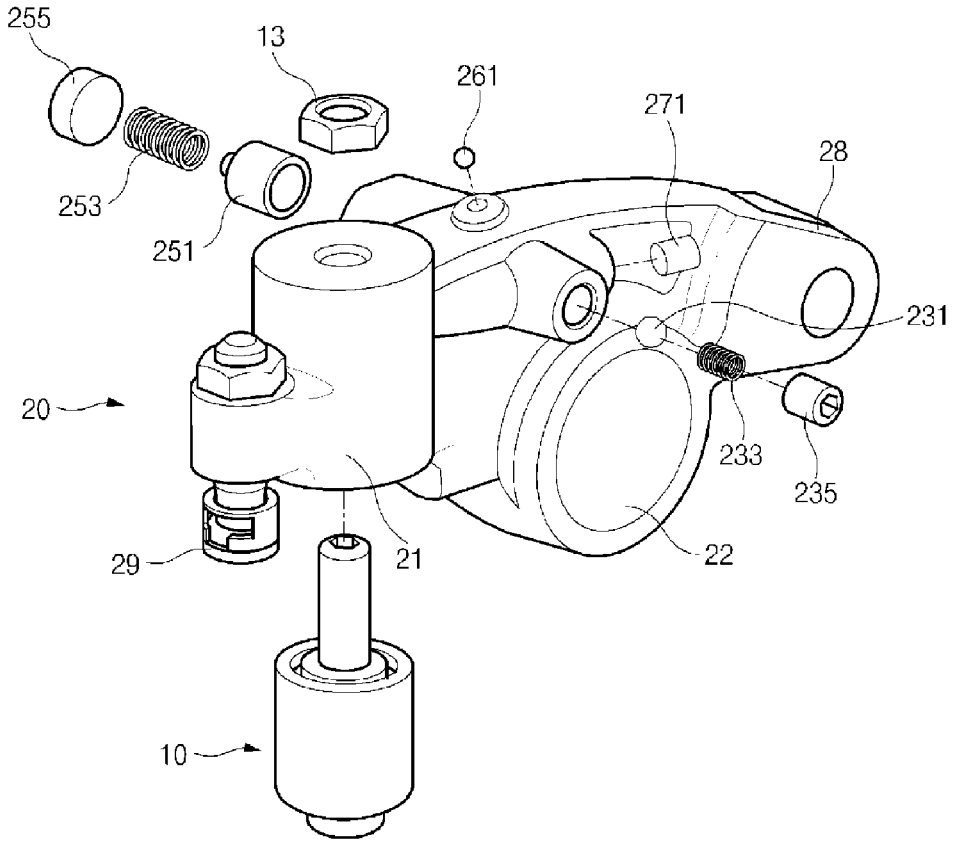
FIG. 6 is an exploded perspective view of a rocker arm.

FIG. 4 is a perspective view illustrating an engine brake apparatus according to an exemplary embodiment of the present invention, FIG. 5 is an exploded perspective view of an actuator, and FIG. 6 is an exploded perspective view of a rocker arm.

In the engine brake apparatus according to the exemplary embodiment of the present invention, the oil is supplied depending on the closing and opening of a solenoid valve 42 and the actuator 10 is integrally installed in the exhaust rocker arm 20 which is installed in an oil line 40 in which an oil pressure is formed and when the actuator is operated, the lift state of the exhaust valve 50 is maintained in the vicinity of a top dead center of the exhaust rocker arm.

First, describing the structure of the actuator 10 with reference to FIG. 5, the actuator is divided into a screw 14 which is integrally fixed with the exhaust rocker arm 20 and a head 12 which is reciprocally fixed to the screw within a predetermined range, in which the screw has a stepped portion disposed at a lower end thereof and an outer diameter portion of the screw is provided with a return spring 16. A lower portion of the return spring 16 is supported by the stepped portion of the screw. The stepped portion of the screw is inserted into a groove of the head 12 and a ring-shaped stopper 18 is inserted into the head 12 in the state in which the screw is inserted and a snap ring 19 is also inserted into the head 12 from above the head 12 and thus the stopper is also fixed to the head. An inner diameter of the stopper is wide enough to allow the screw 14 to be slid and a lower surface of the stopper 18 supports an upper end of the return spring 16.

As illustrated in FIG. 6, the actuator 10 is inserted into the chamber 21 of the exhaust rocker arm 20 and when the portion of the screw 14 is exposed to the upper portion by penetrating through the exhaust rocker arm, the exposed portion is tightened by a nut 13.

An outer diameter of the head 12 is a dimension corresponding to an inner diameter of the chamber 21 and is determined as a dimension to prevent oil in the chamber from leaking while the head appearing and disappearing with respect to the chamber.

Although being described below, when oil is introduced into the chamber 21 to increase a pressure, the pressure beats an elastic force of the return spring 16 so that the actuator 10, more precisely, the head 12 protrudes and when the oil in the chamber leaks and thus the pressure in the chamber is reduced, the head 12 retracts into the chamber by the return spring 16.

In the exhaust rocker arm 20, the chamber 21 is formed at a portion near the exhaust valve, and an intermediate portion is extrapolated into an oil line coupling part 22 so that the exhaust rocker arm may be rotatably coupled with the oil line coupling part. Further, in the exhaust rocker arm 20, a portion facing the chamber based on the oil line coupling part is provided with a roller 28 which contacts a cam 30 which rotates to control the opening and closing time of a suction valve and the exhaust valve.

Referring to FIGS. 6, 7, 11A, 11B, and 11C, an inside of the exhaust rocker arm 20 is provided with a communication line 26 of which one portion communicates with the oil line and another end of the communication line 26 is provided with a distribution line 24 which is branched from the communication line and has one portion extending toward a check ball 231 and another portion extending toward a relief valve 251. That is, when oil is supplied from the oil line, the oil is supplied from the distribution line to the check ball and the relief valve through the communication line.

The communication line 26 is formed from the upper portion of the exhaust rocker arm toward the oil line by drilling and an upper end thereof is finished to prevent the oil from leaking by a sealing ball 26 and the distribution line 26 is formed to penetrate through the exhaust rocker arm in an approximately parallel direction with the oil line.

Both ends of the distribution line 24 are each provided with the check ball 231 and the relief valve 251, in which the check ball 231 is elastically supported by a check spring 233 in a direction which closes the distribution line 24 and the relief valve 251 is elastically supported by a relief spring 253 in a direction in which a discharge line 25 is open.

Both ends of the distribution line are finished by sealing screws 235 and 255 which support the ends of the springs 233 and 253 to prevent the oil from leaking.

Next, a supply line 23 and a discharge line 25 are each formed from a space in which the check ball 231 and the relief valve 251 are received to the chamber 21. The supply line and the discharge line 25 are formed by a machining process such as the drilling and the ends thereof are finished to be sealed by a sealing screw 271.

Reference numeral 29 which is not described represents an adjust screw.

Hereinafter, an operation of the engine brake apparatus according to the exemplary embodiment of the present invention will be described.

Figure 7:
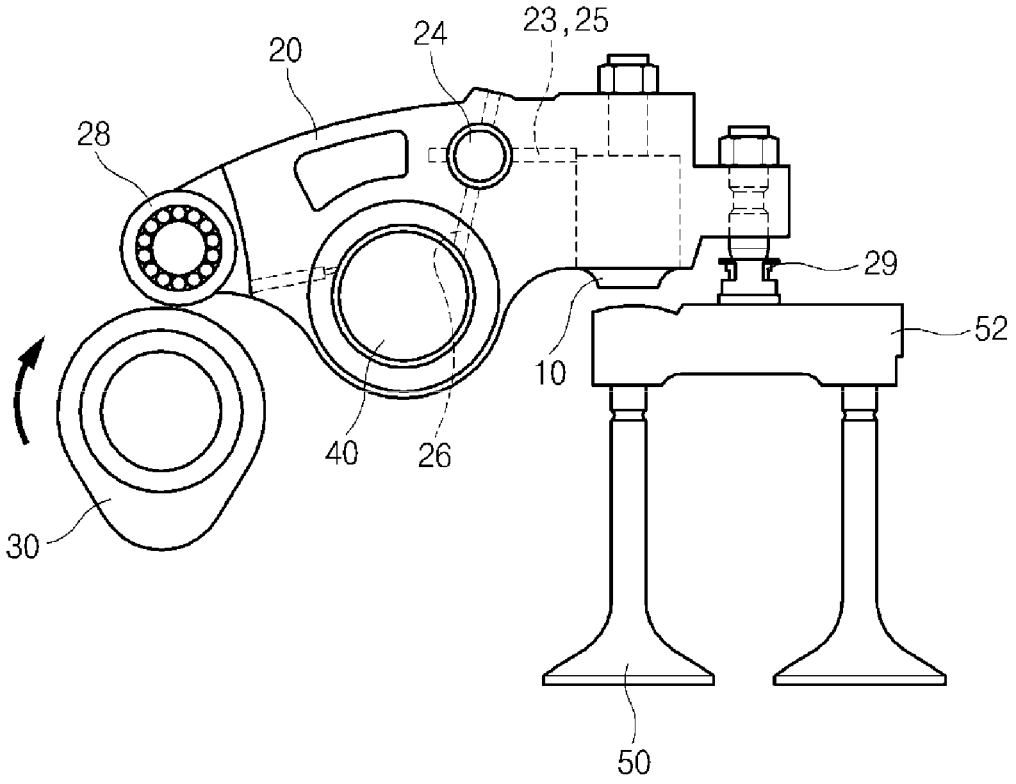
FIG. 7 is a side cross-sectional view of an engine brake apparatus in the state in which an exhaust rocker arm is present at a top dead center and the engine brake is not locked.
Figure 8:
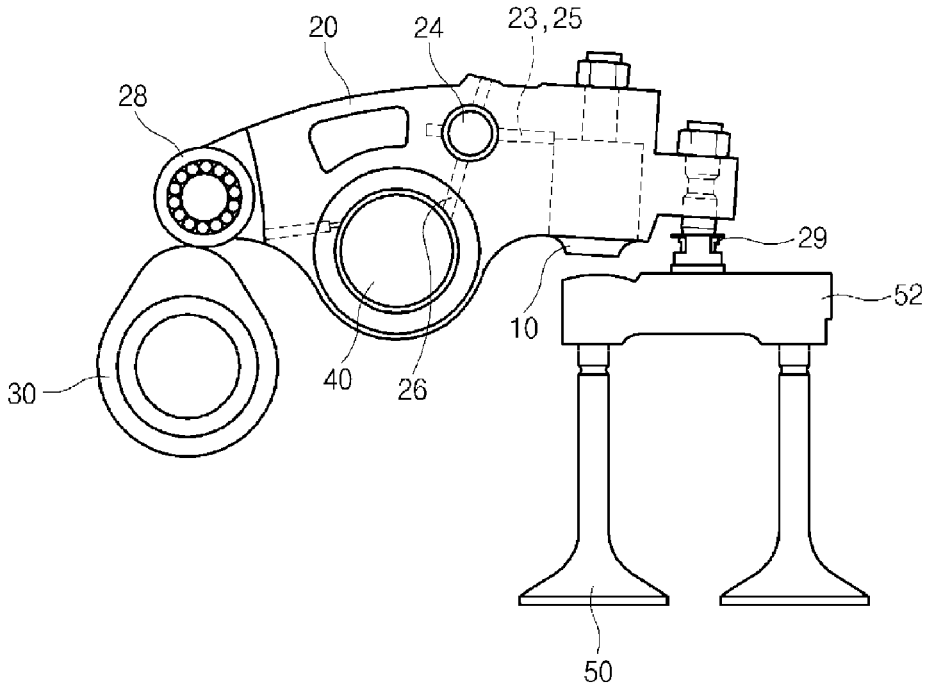
FIG. 8 is a side cross-sectional view of the engine brake apparatus in the state in which the exhaust rocker arm is present at a bottom dead center and the engine brake is not locked.
Figure 9:
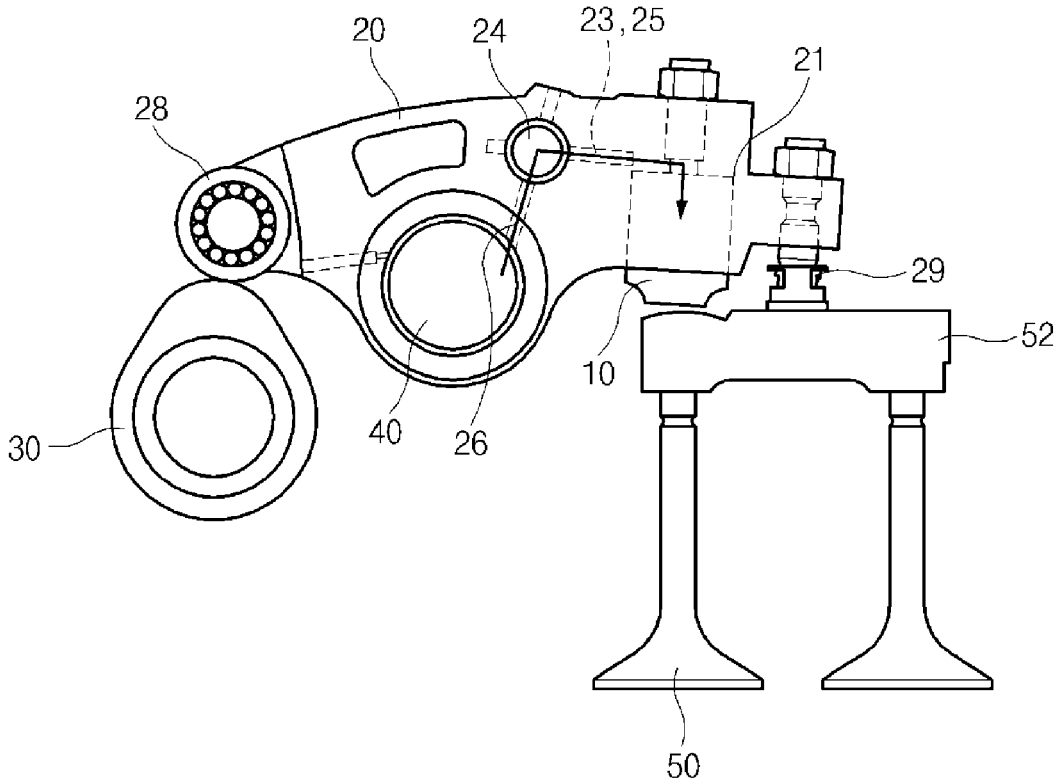
FIG. 9 is a side cross-sectional view of the engine brake apparatus in the state in which the exhaust rocker arm is present at the bottom dead center and the engine brake is locked.
Figure 10:
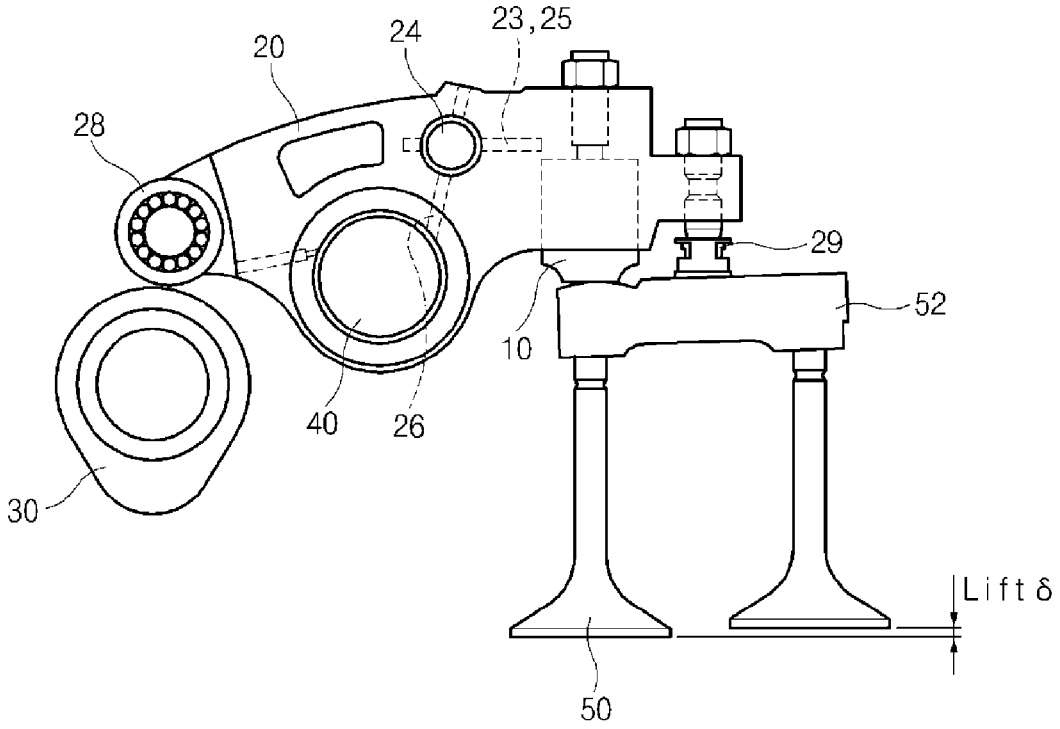
FIG. 10 is a side cross-sectional view of the engine brake apparatus in the state in which the exhaust rocker arm is present at the top dead center and the engine brake is locked.

FIG. 7 is a side cross-sectional view of the engine brake apparatus in the state in which an exhaust rocker arm (strictly speaking, the adjust screw portion of the exhaust rocker arm) is present at a top dead center and the engine brake is not locked, FIG. 8 is a side cross-sectional view of the engine brake apparatus in the state in which the exhaust rocker arm is present at a bottom dead center and the engine brake is not locked, FIG. 9 is a side cross-sectional view of the engine brake apparatus in the state in which the exhaust rocker arm is present at the bottom dead center and the engine brake is locked, and FIG. 10 is a side cross-sectional view of the engine brake apparatus in the state in which the exhaust rocker arm is present at the top dead center and the engine brake is locked.

The rocker arm 20 rotates along a profile of the cam 30 based on the oil line 40 to allow the adjust screw 29 to ascend and descend between the top dead center and the bottom dead center and the adjust screw 29 is connected to a substantially middle portion of a valve bridge 52 and both sides of the valve bridge 52 are connected with the exhaust valve 50. The exhaust rocker arm at the upper position of the one exhaust valve 50 is provided with the actuator 10.

As illustrated in FIG. 7, the exhaust rocker arm 20 does not press the exhaust valve 50 at the position (the top dead center of the exhaust rocker arm) where the actuator is not operated and the cam 30 does not push up the roller 28 of the rocker arm, such that the exhaust port is in a closed state and since the actuator is in a retracted state, the actuator does not contact the exhaust valve.

As illustrated in FIG. 8, the exhaust rocker arm 20 presses the exhaust valve 50 at the position (the bottom dead center of the exhaust rocker arm) where the actuator is not operated and the cam 30 does not push up the roller 28 of the rocker arm, such that the exhaust port is in an opened state and the actuator does not contact the exhaust valve in the state in which the actuator is still in the retracted state.

Meanwhile, as illustrated in FIG. 9, the engine brake is operated at the position (the bottom dead center of the exhaust rocker) where the cam 30 pushes up a roller 28 of the rocker arm to supply oil from the oil line 40 to the chamber 21 through the communication line 26, the distribution line 24, and the supply line 23, such that the actuator 10 descends. In FIG. 9, since the exhaust valve is pressed by the exhaust rocker arm 20, that is, the adjust screw 29 in advance, the actuator does not contact the exhaust valve 50 even though the actuator 10 descends.

As illustrated in FIG. 10, when the chamber 21 supplied with oil is maintained in a high pressure state at the position (the top dead center of the exhaust rocker) where the cam 30 does not push up the roller 28, the descending actuator 10 presses the exhaust valve 50 even in the state in which the adjust screw 29 does not press the exhaust valve 50 to open the valve, thereby implementing the valve lift $\delta$.

When the engine brake is not operated, as illustrated in FIGS. 7 and 8, the actuator 10 does not contact the exhaust valve in the state in which the actuator 10 is in the retracted state and the exhaust valve is opened and closed by the adjust screw 29.

However, when the engine brake is operated, as illustrated in FIGS. 9 and 10, the actuator 10 protrudes and in this state, even though the rocker arm is at the top dead center, one portion of the valve contacts the protruding actuator 10 and is maintained in the slightly pressed state, such that the valve relief $\delta$ is maintained.

Next, an operation of the supply and discharge of oil to operate the actuator or release the operation of the actuator will be described.

Figure 11:
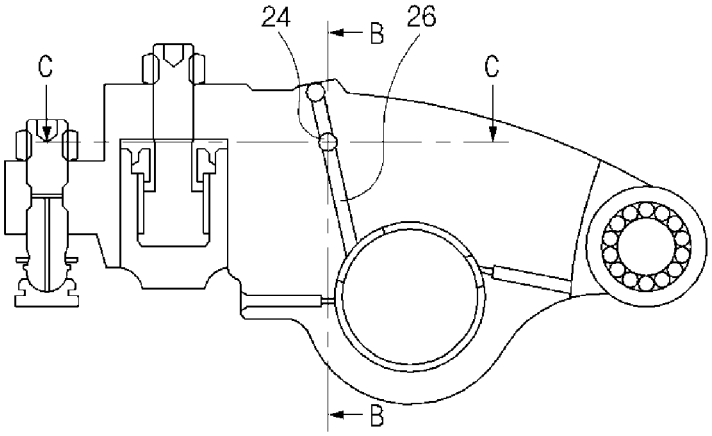
FIG. 11A is a cross-sectional view of the rocker arm and the actuator illustrating the state in which the engine brake is not operated so as not to supply oil.
FIG. 11B is a cross-sectional view of section B-B in FIG. 11A.
FIG. 11C is a cross-sectional view of section C-C in FIG. 11A.
Figure 11:
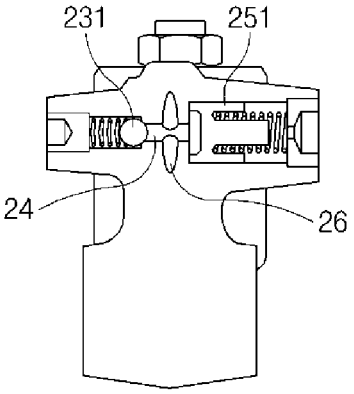
Figure 11:
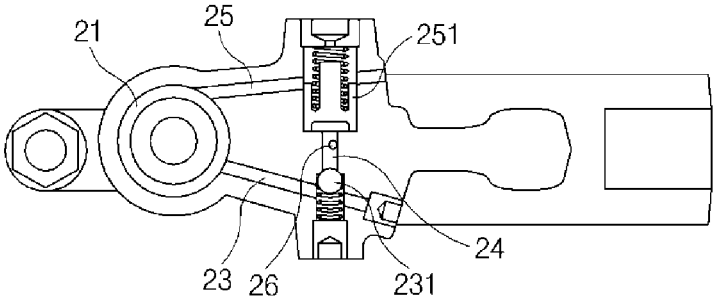
Figure 12:
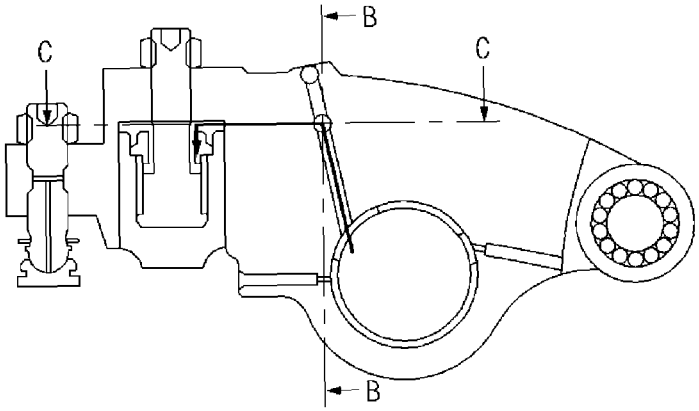
FIG. 12A is a cross-sectional view of the rocker arm and the actuator in the state in which the engine brake is operated to supply oil.
FIG. 12B is a cross-sectional view of section B-B in FIG. 12A.
FIG. 12C is a cross-sectional view of section C-C in FIG. 12A.
Figure 12:
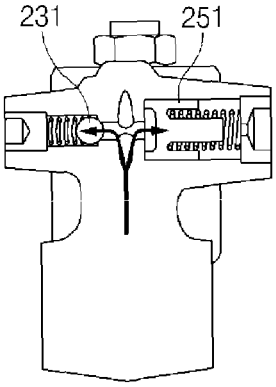
Figure 12:
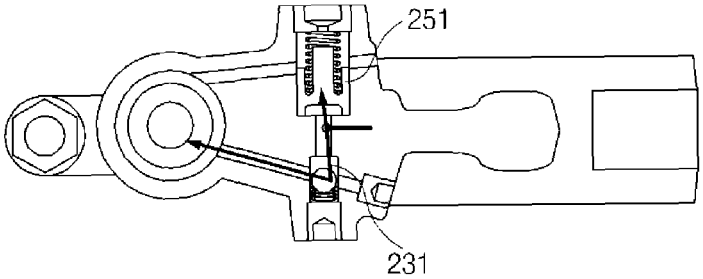
Figure 13:
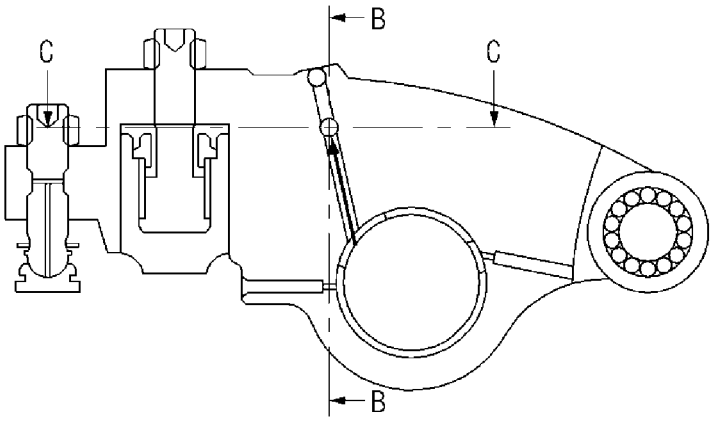
FIG. 13A is a cross-sectional view of the rocker arm and the actuator illustrating the state in which a high-pressure chamber is formed by operating the engine brake so as to supply oil.
FIG. 13B is a cross-sectional view of section B-B in FIG. 13A.
FIG. 13C is a cross-sectional view of section C-C in FIG. 13A.
Figure 13:
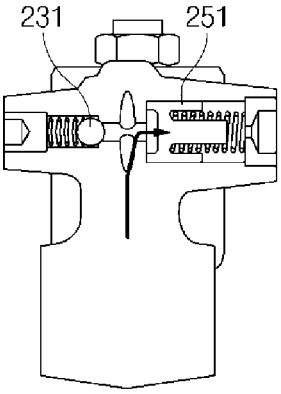
Figure 13:
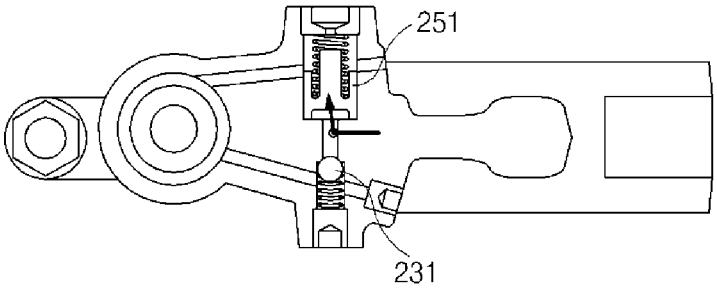
Figure 14:
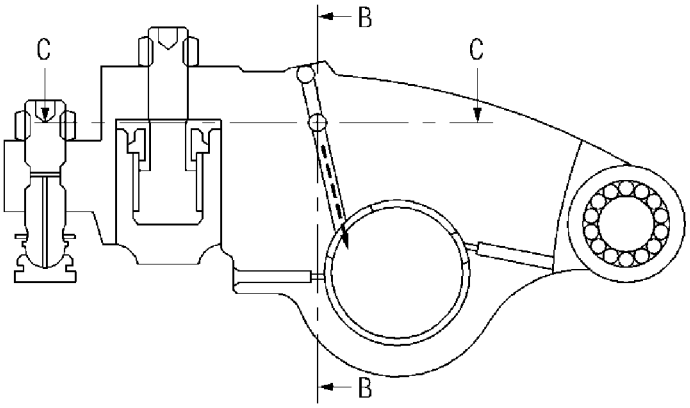
FIG. 14A is a cross-sectional view of the rocker arm and the actuator illustrating the state in which the engine brake is released to discharge oil.
FIG. 14B is a cross-sectional view of section B-B in FIG. 14A.
FIG. 14C is a cross-sectional view of section C-C in FIG. 14A.
Figure 14:
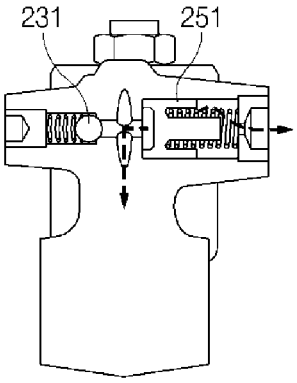
Figure 14:
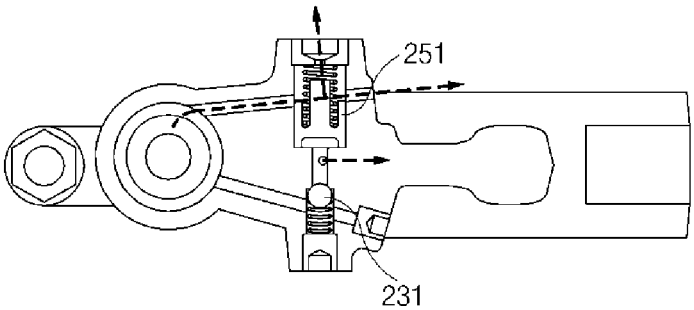

FIG. 11A is a cross-sectional view of the rocker arm and the actuator illustrating the state in which the engine brake is not operated so as not to supply oil, FIG. 12A is a cross-sectional view of the rocker arm and the actuator in the state in which the engine brake is operated to supply oil, FIG. 13A is a cross-sectional view of the rocker arm and the actuator illustrating the state in which a high-pressure chamber is formed by operating the engine brake so as to supply oil, and FIG. 14A is a cross-sectional view of the rocker arm and the actuator illustrating the state in which the engine brake is released to discharge oil.

As illustrated in FIGS. 11A, 11B, and 11C, when not being in the engine brake state, a solenoid valve 42 is not operated, such that the oil pressure does not generate in the oil line 40.

Therefore, the check ball 231 stops the distribution line and the relief valve 251 is in the opened state, by the check spring 233 and the relief spring 253.

In this case, when the engine brake is operated, the solenoid valve 42 is opened to supply oil to the oil line 40 and as illustrated in FIGS. 12A, 12B, and 12C, the oil of the oil line is supplied to the distribution line 24 through the communication line 26. Therefore, the oil pressure in the distribution line 24 is increased, which beats the elastic force of the relief spring 253 and pushes the relief valve 251 to allow the relief valve 251 to close the discharge line 25 and beats the elastic force of the check spring 233 and pushes the checks ball 231 to supply oil to the chamber 21 through the supply line 23.

When the oil is supplied to the chamber to form the oil pressure which is more than a predetermined level so as not to generate a difference in oil pressure enough to beat the elastic force of the check spring 233 between the supply line 23 and the distribution line 24, as illustrated in FIGS. 13A, 13B, and 13C, the check ball 231 stops the distribution line by the elastic force of the check spring 233, but the pressure of the distribution line 24 is not changed, such that the relief valve 25 is continued to be in the closed state. When the state is maintained, the actuator 10 maintains the state protruding from the rocker arm 20, such that the valve lift δ may be obtained even at the top dead center of the rocker arm.

When the engine brake is released in this state, the solenoid valve 42 is closed and the oil pressure of the oil line 40 disappears. Next, as illustrated in FIGS. 14A, 14B, and 14C, the oil pressure of the distribution line 24 disappears and the relief spring 253 pushes the relief valve 251, such that the relief valve is in the opened state. Therefore, the oil in the chamber 21 which forms the high oil pressure is discharged through the discharge line 25, such that the pressure in the chamber is released and the actuator 10 is retracted.

According to the exemplary embodiment of the present invention, the solenoid valve 42 is opened and closed by the operation principle to be able to control the operation of the actuator of the rocker arm.

Figure 15:
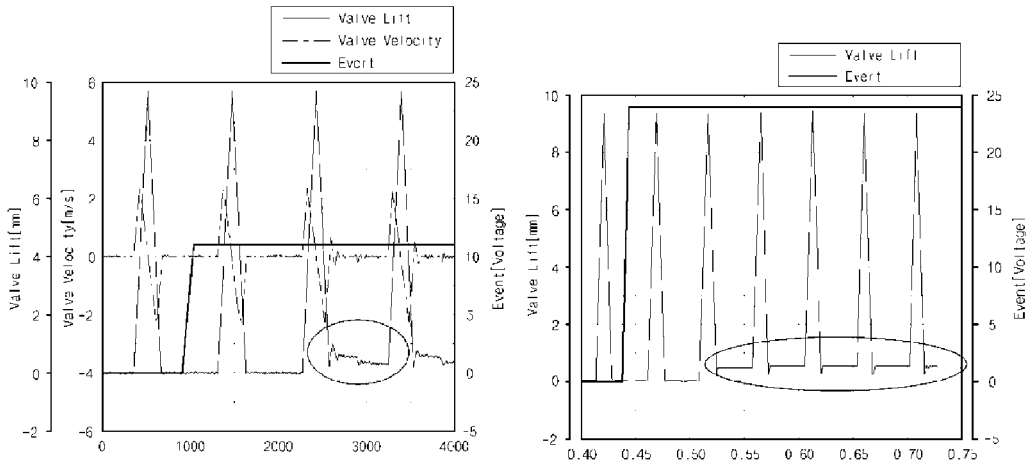
FIG. 15A is a graph illustrating a valve lift state when the engine brake of the engine brake apparatus according to the related art is operated and FIG. 15B is a graph illustrating a valve lift state when the engine brake of the engine brake apparatus according to the exemplary embodiment of the present invention is operated.

FIG. 15A is a graph illustrating a valve lift state when the engine brake of the engine brake apparatus is operated according to the related art and FIG. 15B is a graph illustrating a valve lift state when the engine brake of the engine brake apparatus according to the exemplary embodiment of the present invention is operated.

According to the exemplary embodiment of the present invention, the problem of damage, and the like does not occur, such that the valve lift may be continuously maintained unlike the related art. This is opposite to the related art which causes the degradation in the lift when the damage occurs.

According to the exemplary embodiments of the present invention, the number of components may be reduced to save the cost. Further, the stopper housing may be removed to reduce the weight and the unnecessary deformation of the stopper housing may be avoided to improve the braking performance and the responsiveness, thereby increasing the marketability.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine brake apparatus, comprising:

an exhaust rocker arm, wherein the exhaust rocker arm includes:

a chamber which is formed at a front side and in which an actuator is slidably inserted;

an oil line coupling part which has a central portion extrapolated with an oil line;

a communication line which communicates with the oil line;

a distribution line which is branched from the communication line and has one portion extending toward a check ball and another portion extending toward a relief valve;

a supply line which has one portion connected to the check ball of the distribution line and another portion connected to the chamber; and a discharge line which has one portion connected to the relief valve of the distribution line and another portion connected to the chamber, wherein the check ball is elastically supported by a check spring in a direction in which the distribution line is closed, wherein the relief valve is elastically supported by a relief spring in a direction in which the discharge line is opened, and wherein when a pressure of the distribution line is increased, the pressure beats an elastic force of the check spring and the relief spring to open the check ball and close the relief valve.

2. The engine brake apparatus according to claim 1, wherein the actuator is engaged with a return spring which supports the actuator in a direction in which the actuator is retracted, and wherein when a pressure of the chamber is increased, the pressure beats an elastic force of the return spring to protrude the actuator.

3. The engine brake apparatus according to claim 2, wherein the actuator includes:

a screw which has one portion formed with a stepped portion;

a return spring which is extrapolated into the screw and has one side end supported by the stepped portion;

a head which is formed with a groove in which one portion of the screw is received and is fixed by inserting a stopper and a snap ring into an upper end of the head so as to allow the stopper to support another side end of the return spring in the state in which one portion including the stepped portion of the screw is received in the groove; and a nut which is fastened with another portion of the screw to fix the screw to the chamber.

4. The engine brake apparatus according to claim 1, wherein a rear portion of the exhaust rocker arm is provided with a roller which contacts a cam.

5. A method of operating an engine brake apparatus including an exhaust rocker arm, wherein the exhaust rocker arm includes:

a chamber which is formed at a front side and in which an actuator is slidably inserted;

an oil line coupling part which has a central portion extrapolated with an oil line;

a communication line which communicates with the oil line;

a distribution line which is branched from the communication line and has one portion extending toward a check ball and another portion extending toward a relief valve;

a supply line which has one portion connected to the check ball of the distribution line and another portion connected to the chamber; and a discharge line which has one portion connected to the relief valve of the distribution line and another portion connected to the chamber, and wherein when a pressure of the oil line, the communication line, and the distribution line is increased, opening the check ball to supply oil to the chamber through the supply line; and applying the relief valve with the pressure of the distribution line to be closed, when a pressure of the chamber is increased corresponding to the pressure of the oil line, the communication line, and the distribution line, closing the check ball and the relief valve, and when the pressure of the oil line, the communication line, and the distribution line is reduced, closing the check ball and opening the relief valve to discharge the oil in the chamber through the discharge line.

6. The method according to claim 5, wherein when the oil is supplied to the chamber, the actuator protrudes and when the oil is discharged from the chamber, the actuator is retracted.

7. The method according to claim 6, wherein when the actuator protrudes, the actuator maintains a valve lift even when the exhaust rocker arm arrives in a vicinity of a top dead center.

* * * * *